US011673181B2

(12) United States Patent
Liang et al.

(10) Patent No.: US 11,673,181 B2
(45) Date of Patent: Jun. 13, 2023

(54) DEVICE AND METHOD FOR INSTALLING AND ADJUSTING SLIDING BLOCK OF MULTIPOINT CRANK PRESS

(71) Applicant: Qingdao University of Technology, Shandong (CN)

(72) Inventors: Sen Liang, Shandong (CN); Xinle Chen, Shandong (CN); Guangming An, Shandong (CN)

(73) Assignee: Qingdao University of Technology, Shandong (CN)

( * ) Notice: Subject to any disclaimer, the term of this patent is extended or adjusted under 35 U.S.C. 154(b) by 692 days.

(21) Appl. No.: 16/746,025

(22) Filed: Jan. 17, 2020

(65) Prior Publication Data

US 2021/0046722 A1 Feb. 18, 2021

(30) Foreign Application Priority Data

Aug. 15, 2019 (CN) ..... 201910753285.9

(51) Int. Cl.
*B21J 11/00* (2006.01)
*B30B 15/00* (2006.01)
*B21J 9/18* (2006.01)

(52) U.S. Cl.
CPC ..... *B21J 11/00* (2013.01); *B21J 9/18* (2013.01); *B30B 15/007* (2013.01); (Continued)

(58) Field of Classification Search
CPC ..... B21J 11/00; B21J 9/18; B30B 15/0029; B30B 15/0035; B30B 15/007
(Continued)

(56) References Cited

U.S. PATENT DOCUMENTS 3,592,091 A * 7/1971 Ottavan ..... B26D 7/1827 83/602
4,677,908 A * 7/1987 Imanishi ..... B30B 15/284 74/425
5,321,969 A * 6/1994 Bakermans ..... B21D 28/002 72/450

FOREIGN PATENT DOCUMENTS

CN 103909672 A * 1/2013
CN 103909672 * 7/2014

OTHER PUBLICATIONS

CN103909672A Gu, et alia (Jul. 9, 2014) (MT) (Year: 2014).*

* cited by examiner

*Primary Examiner* — Shelley M Self
*Assistant Examiner* — Fred C Hammers
(74) *Attorney, Agent, or Firm* — Cooper Legal Group, LLC

(57) ABSTRACT

The present invention discloses a device and method for installing and adjusting a sliding block of a multipoint crank press. The device comprises a crank, a connecting rod with an end provided with a U-shaped notch, a sliding block and an eccentric pin shaft micro-adjustment mechanism. The eccentric pin shaft micro-adjustment mechanism is installed at the joint between the connecting rod and the sliding block. The crank, the connecting rod and the sliding block of the multipoint press are normally machined and installed through a classical process, so that the sliding block of the multipoint press runs to a bottom dead center. A gap among mechanisms is eliminated through the loading by a hydraulic loader. The position of one set of crank, connecting rod and sliding block mechanism is taken as a reference, and then the eccentric positions and directions of the eccentric pin shafts at other adjustment positions are finely adjusted, thus real-
(Continued)

izing high-precision assembly and operation of the multi-point press.

20 Claims, 5 Drawing Sheets

(52) U.S. Cl.
CPC ..... *B30B 15/0029* (2013.01); *B30B 15/0035* (2013.01); *Y10T 29/4978* (2015.01)

(58) Field of Classification Search
USPC ..... 100/258 R
See application file for complete search history.

DEVICE AND METHOD FOR INSTALLING AND ADJUSTING SLIDING BLOCK OF MULTIPOINT CRANK PRESS

CROSS-REFERENCE TO RELATED APPLICATIONS

This application claims the benefit of priority from Chinese Patent Application No. 201910753285.9, filed on Aug. 15, 2019. The content of the aforementioned application, including any intervening amendments thereto, is incorporated herein by reference in its entirety.

TECHNICAL FIELD

The present application belongs to the technical field of forging machinery, and particularly relates to a device for installing and adjusting a sliding block of a multipoint crank press and a method for using the same.

BACKGROUND

Multipoint presses play an important role in the heavy machinery machining industry and are widely used. The press achieves the forming of parts by exerting strong pressure on metal blanks to cause plastic deformation and fracture of metals.

However, it is found that in actual production process, due to a connection gap among various parts of the press and errors left from the installation and machining process, a bottom surface of a sliding block is not in line with a working table, and a column guide rail is not exactly vertical to the working table, typically as shown in FIG. 1. As a result, the sliding block cannot move accurately, and a guide rail wears easily, which causes certain damage to a movement mechanism and a transmission mechanism. In addition, die eccentricity, die gnawing, etc. are caused during operation of the press. This seriously affects the precision of the press, the machining quality of workpieces and the service life of a die, and will generate more serious production losses for large multipoint presses.

SUMMARY

In order to overcome the defects in the prior art, an objective of the present application is to provide a safe, efficient, low-cost and high-precision device for installing and adjusting a sliding block of a multipoint crank press.

The technical solution adopted by the present application for solving the technical problems in the prior art is as follows:

A device for adjusting a sliding block of a multipoint crank press, where the device comprises a crank, a sliding block, connecting rods, and eccentric pin shaft micro-adjustment mechanisms;

each of the eccentric pin shaft micro-adjustment mechanism includes an eccentric pin shaft, a large bevel gear and a small bevel gear; wherein one end of the eccentric pin shaft is provided with a positioning part, and an eccentric part is disposed at the position on the eccentric pin shaft close to the positioning part;

one end of the connecting rod is connected to the crank, the other end of the connecting rod is provided with a U-shaped notch, the eccentric pin shaft passes through holes in two side walls of the U-shaped notch, and the holes in the two side walls of the U-shaped notch are in clearance fit with the eccentric pin shaft;

one side wall of the U-shaped notch of the connecting rod is in detachable clearance fit connection with one side of the positioning part of the eccentric pin shaft; the sliding block is mounted on the eccentric part in a clearance fit mode, and an upper portion of the sliding block is positioned in the U-shaped notch;

to fix the large bevel gear, the other side wall of the U-shaped notch of the connecting rod is detachably connected to the large bevel gear; the large bevel gear sleeves the eccentric pin shaft, the large bevel gear is meshed with the small bevel gear, and an axis of the small bevel gear perpendicularly intersects with an axis of the eccentric pin shaft; a central shaft of the small bevel gear passes through a hole of the eccentric pin shaft, and both ends are fixed by a first nut and a second nut.

Further, a dial is also mounted on an end face of the large bevel gear; an adjusting pointer is mounted on an end face of the small bevel gear, and the adjusting pointer is matched with the dial.

Further, an eccentric radius of the eccentric pin shaft is 0.1-1 mm.

Further, the positioning part and the eccentric pin shaft are integrally formed.

Further, one side wall of the U-shaped notch is fixed to the positioning part of the eccentric pin shaft through first bolts; and the other side wall of the U-shaped notch is fixed to the large bevel gear through second bolts.

Further, an axial end face of the small bevel gear is provided with a shaft sleeve coaxial with the small bevel gear, and the axial end face of the small bevel gear and the eccentric pin shaft are axially positioned through the shaft sleeve.

Further, the first nut is disposed at one end of the central shaft provided with the small bevel gear to facilitate rotation of the small bevel gear; a second end of the central shaft of the small bevel gear is provided with a thread, and matched with a second nut after passing through the eccentric pin shaft; and the central shaft of the small bevel gear, the small bevel gear and the first nut are integrally machined.

The present invention also provides a method for adjusting of a multipoint crank press a multipoint crank press by using the foregoing device for adjusting a sliding block, including:

determining an initial position of each of an eccentric pin shaft micro-adjustment mechanism after machining and installing the crank, the connecting rod and the sliding block of the multipoint crank press through a machining and installation process by the following process comprising:

adjusting each of straight lines of eccentric radii of eccentric pin shafts to a horizontal plane relative to ground, where every two of the straight lines of the eccentric radii of different positions point to opposite directions to eliminate the lateral force generated by different the eccentric pin shafts on the sliding block; rotating the position of a dial to make a reading of an adjusting pointer be zero and make the adjusting pointer point right above perpendicular to the horizontal plane, fixing the dial to the large bevel gear, fixing the large bevel gear to the connecting rod by second bolts, and fixing the pointer to a movable small bevel gear;

by turning the crank, thereby moving the connecting rod, and thereby moving the sliding block to a bottom dead center, eliminating a gap among the crank, the sliding block, the connecting rods and eccentric pin shaft micro-adjustment mechanisms by using the loading by a hydraulic loader of the multipoint crank press, measuring a nonparallelism between a lower surface of the sliding block and an upper surface of a working table, and adjusting the eccentric pin shaft through unloading, repeating the foregoing process of measuring a nonparallelism between a lower surface of the sliding block and an upper surface of a working table, adjusting the eccentric pin shaft through unloading until a precision threshold for assembly and operation of the multipoint crank press is met, and fixing the eccentric pin shaft to the connecting rod.

Specifically, the sliding block of the multipoint press runs to the bottom dead center, and loading at a geometric center position of the lower surface of the sliding block by the hydraulic loader, where the loading force is 15%-50% of the nominal pressure of the multipoint crank press. With a first center of a connection position of a first set of crank, connecting rod and sliding block as a reference, a difference between a reading of a second center of a connection position of another set of crank, connecting rod and sliding block and a measured value of a reference position is measured using a dial gauge, and then unloading is performed. Other positions of other sets of eccentric positions and directions of the eccentric pin shafts on cranks, connecting rods and sliding block are finely adjusted. A movable small bevel gear shaft is rotated according to the measured relative height reading difference and the scale on the dial gauge, so that the pointer of the dial reaches the position of the measured relative height difference and stops. Then loading is performed again at the geometric center position of the lower surface of the sliding block by using the hydraulic loader. The foregoing process is repeated, and adjustment directions of the eccentric pin shaft at different positions are opposite, gaps among the crank, the sliding block, the connecting rods and eccentric pin shaft micro-adjustment mechanisms are eliminated; and the eccentric pin shaft is fixed on one side of the second end of the connecting rod with a U-shaped notch until the nonparallelism between the lower surface of the sliding block and the upper surface of the working table meets design requirements under conditions.

Beneficial effects of the present invention are as follows:

In a large multipoint crank press, due to errors in part machining and assembling, the nonparallelism between the lower surface of the sliding block and the upper surface of the working table is greatly increased, which seriously affects the working accuracy and service life of the press and workpiece machining quality. According to the present application, the eccentric pin shaft micro-adjustment mechanism is designed between the connecting rod and the sliding block. The crank, the connecting rod and the sliding block of the multipoint press are normally machined and installed through a classical machining and installation process, so that a sliding block mechanism of the multipoint press runs to a bottom dead center. Straight lines of eccentric radii of eccentric pin shafts are each first adjusted to a horizontal position, namely a connecting line pointing to a circle center of an eccentric part from a circle center of a pin shaft positioning part, where every two of the straight lines of the eccentric radii of different positions point to opposite directions to eliminate the lateral force generated by the eccentric pin shaft on the sliding block. A gap among mechanisms is eliminated through the loading by a hydraulic loader. A center of a connecting position of one set of crank, connecting rod and sliding block mechanism is taken as a reference, and then the eccentric positions and directions of the eccentric pin shafts at different positions are finely adjusted, thus realizing high-precision assembly and operation of the multipoint press. The operation of the press and the machining precision of workpieces are improved to the greatest extent, and the structure is simple and has strong practical significance.

BRIEF DESCRIPTION OF THE DRAWINGS

The accompany drawings of the specification constituting a part of the present application provide further understanding of the present application. The schematic embodiments of the present application and description thereof are intended to be illustrative of the present application and do not constitute an undue limitation of the present application.

In the figure: 1. crank, 2. side wall of a U-shaped notch at a small end of a connecting rod (corresponding to the right side in FIG. 3), 3. large bevel gear, 4. eccentric pin shaft, 5. small bevel gear shaft, 6. dial, 7. sliding block, 8. adjusting pointer, 9. side wall of a U-shaped notch at a small end of a connecting rod (corresponding to the left side in the FIG. 3), 10. positioning part, 11. eccentric part, 12. connecting rod, 13. first bolt, 14. second bolt, 15. first nut, 16. second nut, 17. shaft sleeve, 18. thread.

DETAILED DESCRIPTION

It should be noted that the following detailed description is exemplary and aims to further describe the present invention. Unless otherwise specified, all technical and scientific terms used herein have the same meaning as commonly understood by one of ordinary skill in the technical field to which the present application belongs.

It should be noted that the terms used herein are merely used for describing the specific embodiments, but are not intended to limit exemplary embodiments of the present invention. As used herein, the singular form is also intended to include the plural form unless otherwise indicated obviously from the context. Furthermore, it should be further understood that the terms "include" and/or "comprise" used in this specification specify the presence of stated features, steps, operations, elements, components and/or a combination thereof.

Noun explanation: In this embodiment, a large bevel gear and a movable small bevel gear have no specific size requirements, as long as the number of teeth of the large bevel gear is much larger than that of teeth of the movable small bevel gear.

Figure 1:
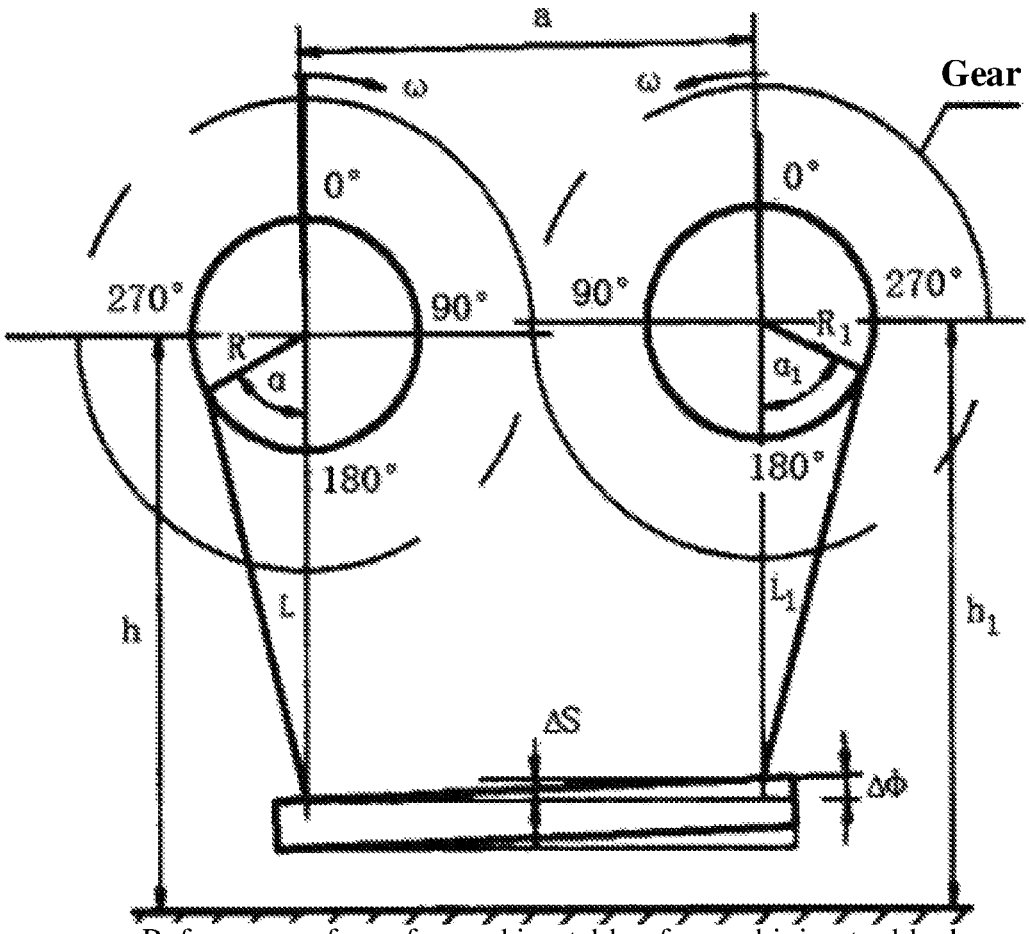
FIG. 1 is a principle of error generation in the operation of a multipoint crank press.

As described in the background, in the actual production process, due to a connection gap among various parts of the press and errors left from the installation and machining process, a bottom surface of a sliding block is not in line with a working table, and a column guide rail is not exactly vertical to the working table, typically as shown in FIG. 1. As a result, the sliding block cannot move accurately, and a guide rail wears easily, which causes certain damage to a movement mechanism and a transmission mechanism. In addition, die eccentricity, die gnawing, etc are caused during operation of the press. This seriously affects the precision of the press, the machining quality of workpieces and the service life of a die, and will generate more serious production losses for large multipoint presses.

In order to solve the problem, in the present invention, an adjusting device is mounted between a sliding block and a connecting rod of a multipoint crank press. The device is mainly comprised of a crank 1, a connecting rod 12, a sliding block 7 and an eccentric pin shaft micro-adjustment mechanism.

The eccentric pin shaft micro-adjustment mechanism includes an eccentric pin shaft 4, a fixed large bevel gear 3, a movable small bevel gear shaft 5, a dial 6 and an adjusting pointer 8; one side of the eccentric pin shaft 4 is provided with a positioning part 10, and an eccentric part 11 is disposed at the position of the eccentric pin shaft 4 close to the positioning part.

One end of the connecting rod 12 is a large end, the other end is a small end, and the small end is provided with a U-shaped notch.

The large end of the connecting rod 12 is connected to the crank 1, the small end of the connecting rod 12 is provided with the U-shaped notch, and both sides of the U-shaped notch at the small end of the connecting rod are connected to the eccentric pin shaft 4.

A side wall 2 of the U-shaped notch at the small end of the connecting rod is in detachable high-precision clearance fit connection with one side of the positioning part 10 of the eccentric pin shaft 4; and the sliding block 7 sleeves the eccentric part 11.

A side wall 9 of the U-shaped notch at the small end of the connecting rod is in high-precision clearance fit connection with a pin shaft section at the other side of the eccentric pin shaft 4, and the side wall 9 of the U-shaped notch at the small end of the connecting rod is also connected to the fixed large bevel gear 3 to fix the large bevel gear.

The fixed large bevel gear 3 sleeves the eccentric pin shaft 4 and is detachably connected to the side wall 9 of the U-shaped notch at the small end of the connecting rod; the fixed large bevel gear 3 is meshed with the movable small bevel gear shaft; the movable small bevel gear shaft 5 passes through a hole in the eccentric pin shaft 4 and is fixed by a first nut 15 and a second nut 16; and an axis of the movable small bevel gear shaft and an axis of the eccentric pin shaft perpendicularly intersect.

This embodiment takes a 4-point press as an example, and the implementation of the present application will be described in more detail below with reference to FIGS. 1 to 6.

FIG. 1 is a schematic diagram of errors generated in the operation of a sliding block of a large multipoint crank press. Due to various errors existing in the installation and machining of a crank, a connecting rod and a sliding block, a bottom surface of the sliding block is not parallel to a working table, and a column guide rail is not perpendicular to the sliding block. As a result, the sliding block cannot move accurately, and a guide rail wears easily. In addition, die eccentricity, die gnawing, etc are caused during operation of the press, and workpiece machining accuracy is reduced.

Figure 2:
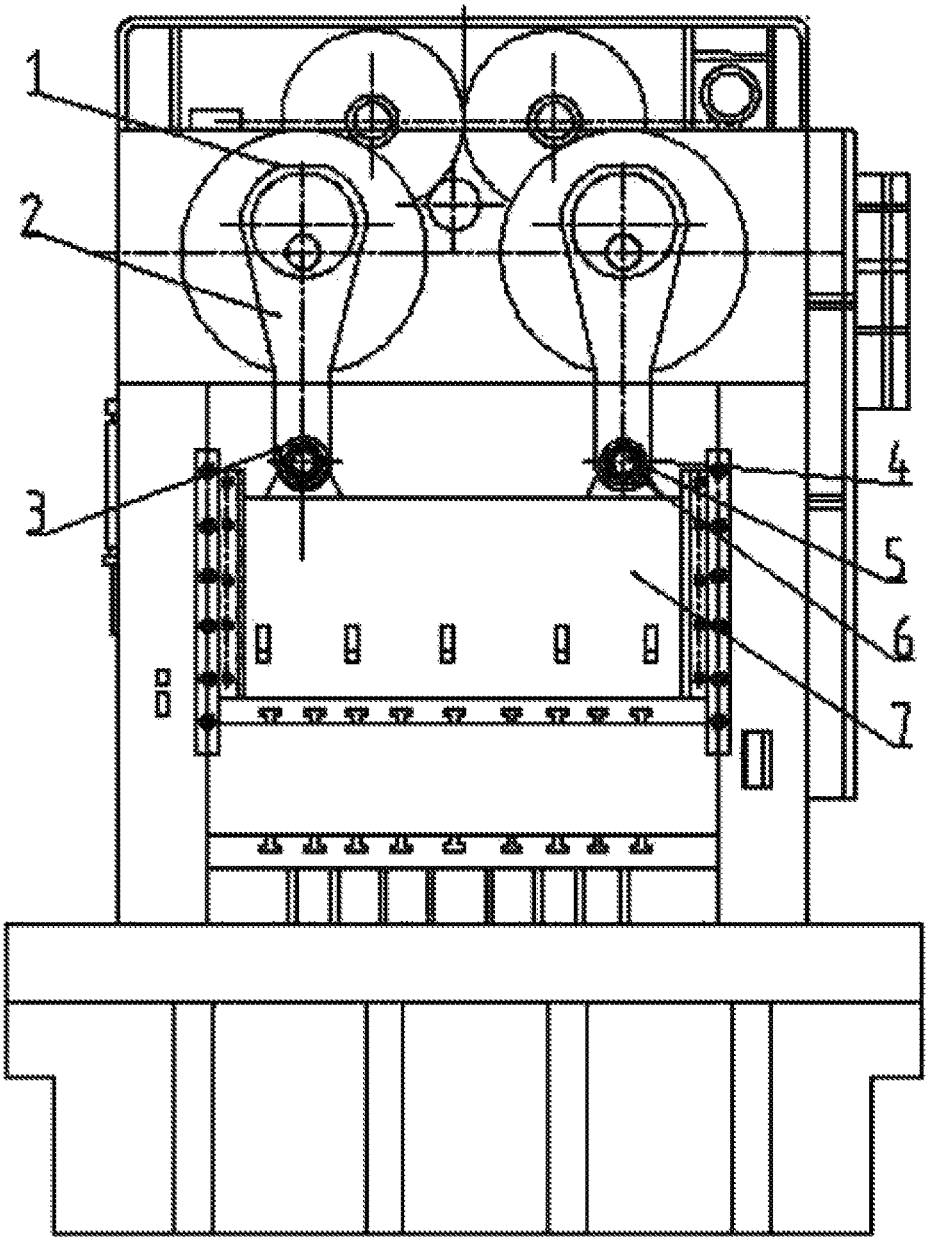
FIG. 2 is a front view of the multipoint crank press.
Figure 3:
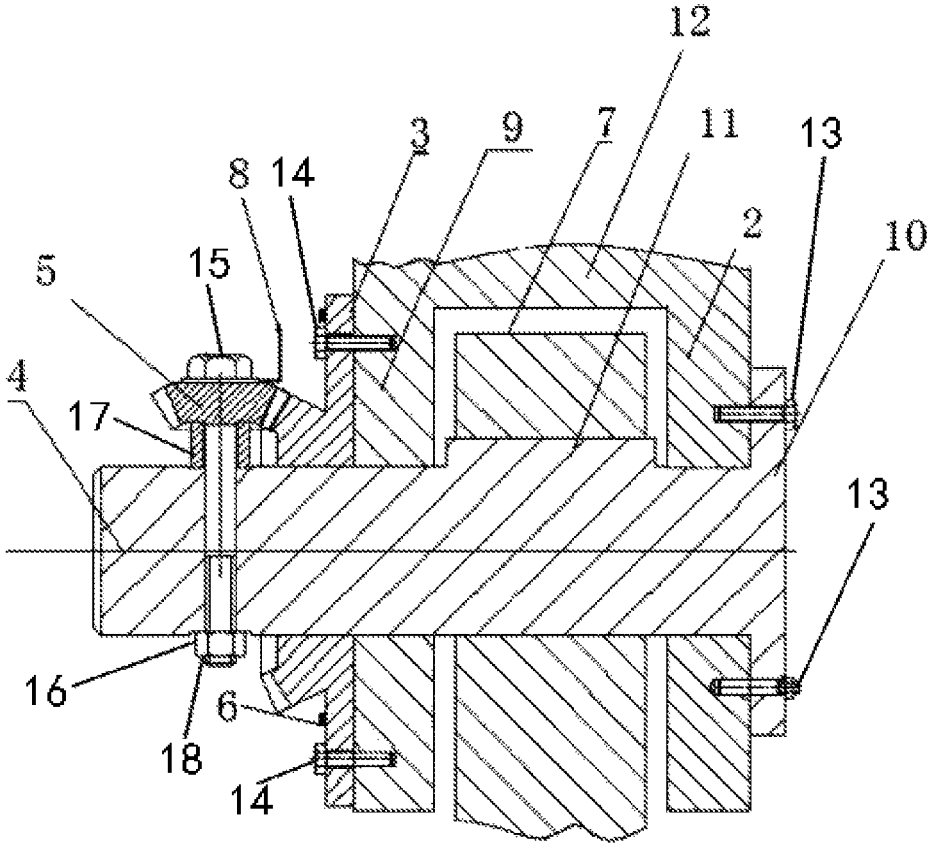
FIG. 3 is a partial enlarged view of an eccentric pin shaft micro-adjustment mechanism.
Figure 4:
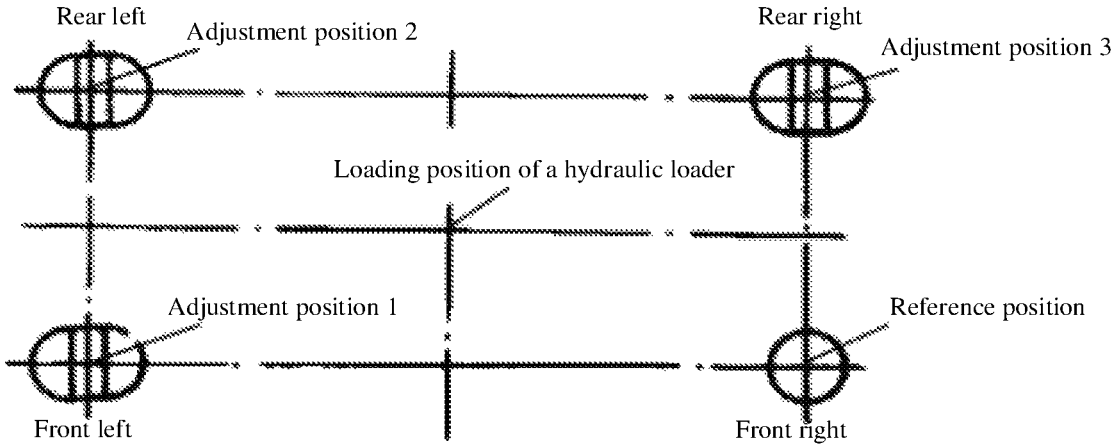
FIG. 4 is a diagram showing a reference position, a loading position and adjustment positions of a lower surface of a sliding block of the multipoint crank press.
Figure 5:
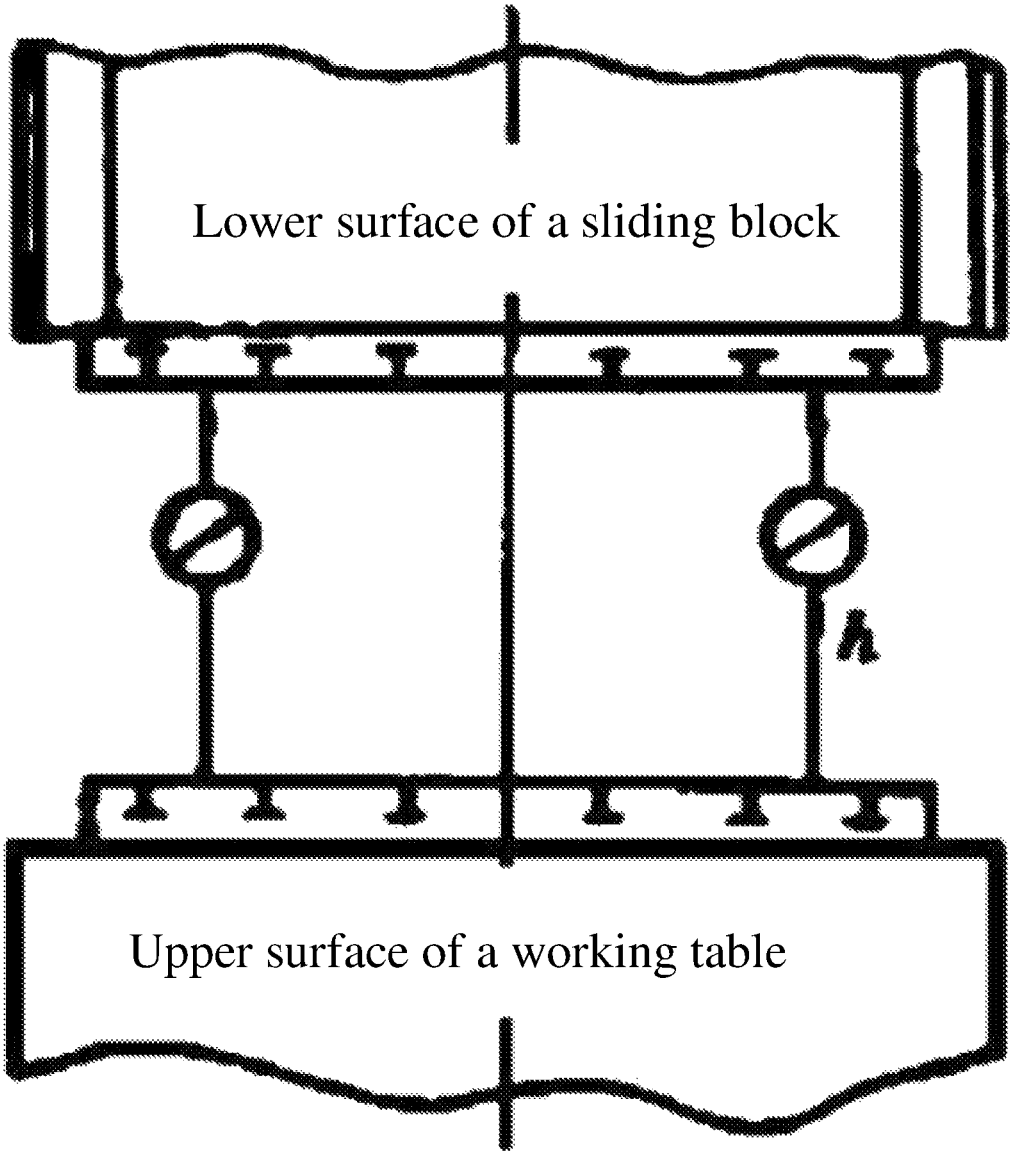
FIG. 5 is a diagram of measurement of a nonparallelism between the lower surface of the sliding block and an upper surface of a working table.
Figure 6:
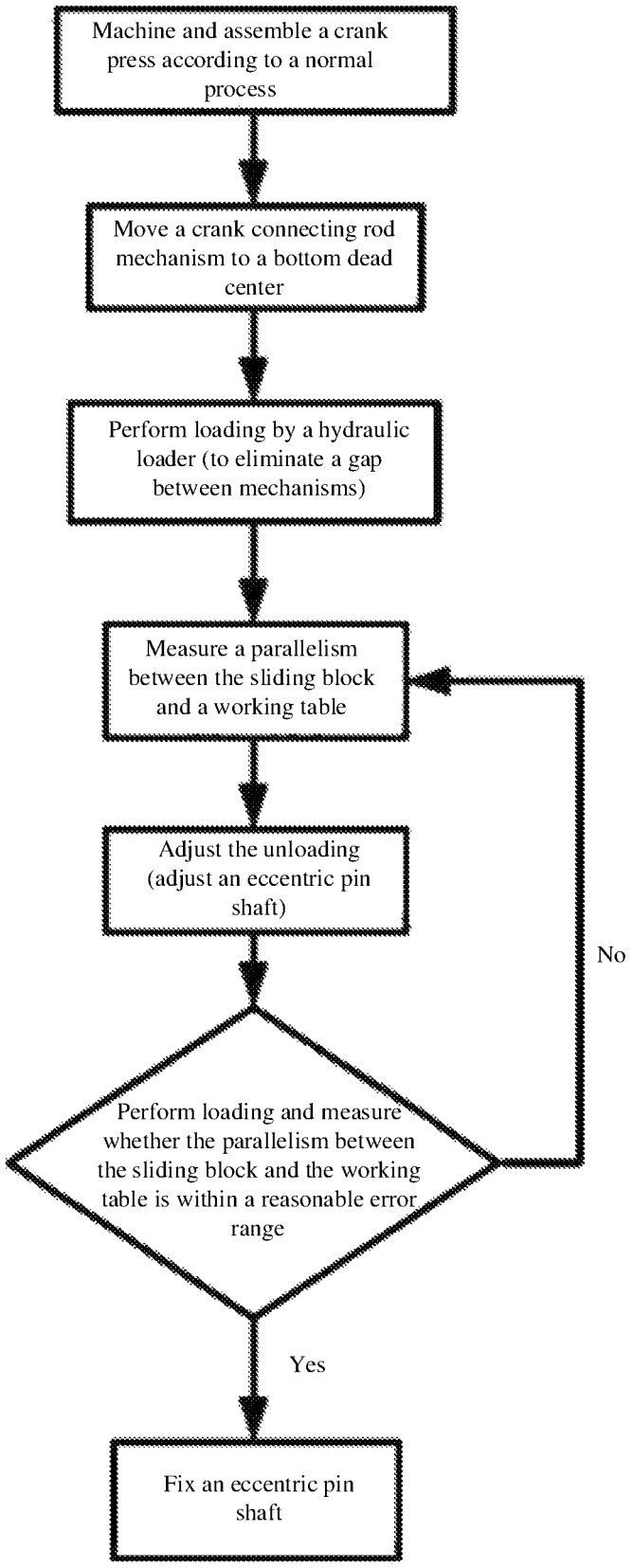
FIG. 6 is a flow chart of adjustment of a parallelism between the lower surface of the sliding block and the upper surface of the working table.

This embodiment is explained from measurement and adjustment, where FIG. 1 shows the principle of errors generated in the operation of the multipoint crank press; FIG. 2 is a front view of the multipoint crank press; FIG. 3 is a partial enlarged view of an eccentric pin shaft micro-adjustment mechanism; FIG. 4 is a diagram showing a reference position, a loading position and adjustment positions of a lower surface of a sliding block of the multipoint crank press; FIG. 5 is a diagram of measurement of a nonparallelism between the lower surface of the sliding block and an upper surface of a working table; and FIG. 6 is a flow chart of adjustment of a parallelism between the lower surface of the sliding block and the upper surface of the working table. The specific device includes a crank 1, a connecting rod 12 with a small end provided with a U-shaped notch, a sliding block 7 and an eccentric pin shaft micro-adjustment mechanism.

The eccentric pin shaft micro-adjustment mechanism consists of a side wall 2 of the U-shaped notch at the small end of the connecting rod, a fixed large bevel gear 3, an eccentric pin shaft 4, a side wall 9 of the U-shaped notch at the small end of the connecting rod, a movable small bevel gear shaft 5, a dial 6 and an adjusting pointer 8.

One end of the eccentric pin shaft 4 is provided with a positioning part 10 corresponding to the right part in FIG. 3, and the positioning part and the eccentric pin shaft are integrally formed; and an eccentric part 11 is disposed at the position of the eccentric pin shaft close to the positioning part.

A large end of the connecting rod with the small end provided with the U-shaped notch is connected to the crank 1. The side wall 2 of the U-shaped notch at the small end of the connecting rod is connected to an eccentric pin shaft section at one side of the eccentric part (corresponding to the right side in FIG. 3) and detachably connected to the positioning part 10. Preferably, bolted connection is selected; and the sliding block sleeves the eccentric part 11.

The side wall 9 of the U-shaped notch at the small end of the connecting rod is connected to an eccentric pin shaft section at the other side of the eccentric part (corresponding to the left side in the figure).

The fixed large bevel gear 3 sleeves the eccentric pin shaft 4 and is detachably connected to the side wall 9 of the U-shaped notch at the small end of the connecting rod; and preferably, bolted connection is selected. The fixed large bevel gear 3 is meshed with the movable small bevel gear 5; a central shaft of the movable small bevel gear 5 passes through the eccentric pin shaft 4 through a hole and is fixed by a second nut 16. An axis of the movable small bevel gear 5 and an axis of the eccentric pin shaft 4 perpendicularly intersect. Positioning is carried out between the end face of the movable small bevel gear 5 and the eccentric pin shaft through a shaft sleeve sleeving the movable small bevel gear shaft.

In the central shaft of the small bevel gear, a first nut is disposed at one end of the central shaft provided with the small bevel gear to facilitate rotation of the small bevel gear; the other end of the central shaft is provided with a thread, and matched with a second nut after passing through the eccentric pin shaft 4; and the central shaft of the small bevel gear, the small bevel gear and the first nut are integrally machined.

The dial 6 is also mounted on a positioning end face of the fixed large bevel gear 3, and a spot welding mode can be used specifically; the adjusting pointer 8 is mounted on the end face of the movable small bevel gear shaft, and the adjusting pointer 8 is connected to the movable small bevel gear shaft by spot welding; and the adjusting pointer 8 is matched with the dial 6.

Aspect of measurement: according to the device for installing and adjusting a sliding block of a multipoint crank press provided by the present application, the eccentric pin shaft micro-adjustment mechanism is designed between the connecting rod and the sliding block, specifically as shown in FIGS. 2, 3 and 4. The micro-adjustment mechanism involves the crank 1, the connecting rod 12, the fixed large bevel gear 3, the eccentric pin shaft 4, the movable small bevel gear 5, the dial 6, the sliding block 7 and the adjusting pointer 8. The multipoint crank press is machined and assembled first according to a normal machining and assembling process, and then the multipoint crank press runs to a bottom dead center; straight lines of eccentric radii of all eccentric pin shafts are adjusted to horizontal positions and directions, and every two of the straight lines point to opposite directions; the dial 6 is rotated to make a reading of the adjusting pointer 8 be zero and make the adjusting pointer point right above perpendicular to the horizontal plane; the large bevel gear 3 is fixed to the side wall 9 of the U-shaped notch at the small end of the connecting rod by a connecting screw, the adjusting pointer 8 is fixed to the central shaft of the movable bevel gear through spot welding, and the fixed large bevel gear 3 is fixed to the dial 6 through spot welding. This embodiment is a 4-point press, that is, straight lines of eccentric radii of 4 eccentric pin shafts are each adjusted to a horizontal position and direction, namely a connecting line pointing to a circle center of the eccentric part from a circle center of the pin shaft positioning part, and every two of the eccentric radii of different positions point to opposite directions (if the reference position is at 0 degrees horizontally, the adjustment position 1 is at 180 degrees, the adjustment position 2 is at 180 degrees, and the adjustment position 3 is at 0 degree) to eliminate the lateral force generated by the eccentric pin shaft on the sliding block, and a gap among mechanisms is eliminated by the loading by a hydraulic loader.

In a device for installing and adjusting a sliding block of a large multipoint crank press, an eccentric pin shaft 4 is designed between a connecting rod and a sliding block, an eccentric radius of the eccentric pin shaft is 0.1-1 mm, and the eccentric radii of the eccentric pin shafts on one machine should be good in consistency.

FIG. 4 is a diagram showing a reference position, a loading position and adjustment positions of the lower surface of the sliding block of the multipoint crank press. Since the sliding blocks generally have a symmetrical structure, the loading position of the hydraulic loader is applied to the geometric center position of the lower surface of the sliding block of the crank press. This embodiment is a 4-point press, and the specific loading position is as shown in FIG. 4. The loading pressure of the hydraulic loader is gradually increased. The final loading force of this embodiment reaches 30% of the nominal force of the crank press and the hydraulic loader stops pressure rise, and this pressure is maintained.

After the loading pressure of the hydraulic loader reaches 30% of the nominal pressure of the crank press, a reference position and 3 adjustment positions are found on the lower surface of the sliding block of the multipoint crank press, which are the force application center positions of each crank press for the sliding block, specifically marked in FIG. 4. The height differences of the 3 adjustment positions and the reference position of the lower surface of the sliding block of the crank press relative to a working table surface are measured through a dial gauge, specifically as shown in FIG. 5. After the relative height differences of the adjustment positions and the reference position are recorded respectively, the dial gauge is taken out, and unloading is performed on the hydraulic loader.

Aspect of adjustment: based on the recorded relative height differences, the eccentric pin shaft micro-adjustment mechanisms between the corresponding connecting rod and the sliding block corresponding to the 3 adjustment positions are adjusted one by one. Since the dial 6 and the fixed large bevel gear 3 have been fixed to the connecting rod, according to the measured relative height difference and the scale on the dial, the central shaft of the movable small bevel gear is rotated with a wrench to stop its pointer at the position of the measured relative height difference, and it should be noted that the micro-adjustment directions of the eccentric pin shafts at different positions are opposite.

The foregoing process is repeated until the relative height difference meets the design requirements, and finally the eccentric pin shaft is relatively fixed to the connecting rod through a screw. The specific adjustment process is shown in FIG. 6.

According to the present invention, the parallelism between the working bottom surface of the sliding block and the working table in the loading state of the press is ensured by a simple and efficient design, and the machining precision of the press and the service life of the die are greatly improved.

The present application has been exemplarily described with reference to the accompanying drawings above. Obviously, the specific implementation of the present application is not limited by the foregoing modes. Various immaterial improvements made by using the method concept and technical solutions of the present application or direct application of the concept and the technical solutions of the present application to other occasions without improvement shall fall within the protection scope of the present application.

Parts not involved in the present application are the same as those of the prior art or can be implemented by using the prior art.

What is claimed is:

1. A device for adjusting a sliding block of a multipoint crank press, wherein the device comprises a crank, a sliding block, connecting rods, and eccentric pin shaft micro-adjustment mechanisms;

each of the eccentric pin shaft micro-adjustment mechanisms comprises an eccentric pin shaft, a large bevel gear and a small bevel gear, wherein one end of the eccentric pin shaft is provided with a positioning part, and an eccentric part is disposed at a position on the eccentric pin shaft close to the positioning part;

a first end of each of the connecting rods is connected to the crank, a second end of each of the connecting rods is provided with a U-shaped notch, the eccentric pin shaft passes through holes in two side walls of the U-shaped notch, and the holes in the two side walls of the U-shaped notch are in clearance fit with the eccentric pin shaft;

a first side wall of the two side walls of the U-shaped notch of each of the connecting rods is in detachable clearance fit connection with one side of the positioning part of the eccentric pin shaft, the sliding block is mounted on the eccentric part in a clearance fit mode, and an upper portion of the sliding block is positioned in the U-shaped notch;

to fix the large bevel gear, a second side wall of the two side walls of the U-shaped notch of each of the connecting rods is detachably connected to the large bevel gear, the large bevel gear sleeves the eccentric pin shaft, the large bevel gear is meshed with the small bevel gear, an axis of the small bevel gear perpendicularly intersects with an axis of the eccentric pin shaft, a central shaft of the small bevel gear passes through a hole of the eccentric pin shaft, and both ends of the small bevel gear are fixed by a first nut and a second nut.

2. The device for adjusting a sliding block of a multipoint crank press according to claim 1, wherein a dial is mounted on an end face of the large bevel gear, an adjusting pointer is mounted on an axial end face of the small bevel gear, and the adjusting pointer is matched with the dial.

3. The device for adjusting a sliding block of a multipoint crank press according to claim 1, wherein an eccentric radius of the eccentric pin shaft is 0.1-1 mm.

4. The device for adjusting a sliding block of a multipoint crank press according to claim 1, wherein the positioning part and the eccentric pin shaft are integrally formed.

5. The device for adjusting a sliding block of a multipoint crank press according to claim 1, wherein the first side wall of the U-shaped notch is fixed to the positioning part of the eccentric pin shaft through first bolts, and the second side wall of the U-shaped notch is fixed to the large bevel gear through second bolts.

6. The device for adjusting a sliding block of a multipoint crank press according to claim 1, wherein an axial end face of the small bevel gear is provided with a shaft sleeve coaxial with the small bevel gear, and the axial end face of the small bevel gear and the eccentric pin shaft are axially positioned through the shaft sleeve.

7. The device for adjusting a sliding block of a multipoint crank press according to claim 1, wherein the first nut is disposed at a first end of the central shaft of the small bevel gear to facilitate rotation of the small bevel gear, a second end of the central shaft of the small bevel gear is provided with a thread and matched with a second nut after passing through the eccentric pin shaft, and the central shaft of the small bevel gear, the small bevel gear and the first nut are integrally machined.

8. A method for adjustment of a multipoint crank press by using the device for adjusting a sliding block according to claim 1, comprising:

determining an initial position of each of the eccentric pin shaft micro-adjustment mechanisms after machining and installing the crank, the connecting rods, and the sliding block of the multipoint crank press through a machining and installation process by a process comprising:

adjusting each of straight lines of eccentric radii of eccentric pin shafts to a horizontal plane relative to ground, wherein every two of the straight lines of the eccentric radii of different positions point to opposite directions to eliminate a lateral force generated by different eccentric pin shafts on the sliding block, rotating a position of a dial to make a reading of an adjusting pointer be zero and make the adjusting pointer point right above perpendicular to the horizontal plane, fixing the dial to the large bevel gear, fixing the large bevel gear to the connecting rods by second bolts, and fixing the adjusting pointer to a movable small bevel gear;

turning the crank, thereby moving the connecting rods, and thereby moving the sliding block to a bottom dead center, eliminating a gap among the crank, the sliding block, the connecting rods and the eccentric pin shaft micro-adjustment mechanisms by using loading by a hydraulic loader of the multipoint crank press, measuring a nonparallelism between a lower surface of the sliding block and an upper surface of a working table, adjusting the eccentric pin shaft through unloading, repeating the foregoing process of measuring a nonparallelism between the lower surface of the sliding block and the upper surface of the working table, adjusting the eccentric pin shaft through unloading until a precision threshold for assembly and operation of the multipoint crank press is met, and finally fixing the eccentric pin shaft to the connecting rods.

9. A method for adjustment of a multipoint crank press by using the device for adjusting a sliding block according to claim 2, comprising:

determining an initial position of each of the eccentric pin shaft micro-adjustment mechanisms after machining and installing the crank, the connecting rods, and the sliding block of the multipoint crank press through a machining and installation process by a process comprising:

adjusting each of straight lines of eccentric radii of eccentric pin shafts to a horizontal plane relative to ground, wherein every two of the straight lines of the eccentric radii of different positions point to opposite directions to eliminate a lateral force generated by different eccentric pin shafts on the sliding block, rotating a position of the dial to make a reading of the adjusting pointer be zero and make the adjusting pointer point right above perpendicular to the horizontal plane, fixing the dial to the large bevel gear, fixing the large bevel gear to the connecting rods by second bolts, and fixing the adjusting pointer to a movable small bevel gear shaft;

turning the crank, thereby moving the connecting rods, and thereby moving the sliding block to a bottom dead center, eliminating a gap among the crank, the sliding block, the connecting rods and the eccentric pin shaft micro-adjustment mechanisms by using loading by a hydraulic loader of the multipoint crank press, measuring a nonparallelism between a lower surface of the sliding block and an upper surface of a working table, adjusting the eccentric pin shaft through unloading, repeating the foregoing process of measuring a nonparallelism between the lower surface of the sliding block and the upper surface of the working table, adjusting the eccentric pin shaft through unloading until a precision threshold for assembly and operation of the multipoint crank press is met, and finally fixing the eccentric pin shaft to the connecting rod.

10. A method for adjustment of a multipoint crank press by using the device for adjusting a sliding block according to claim 3, comprising:

determining an initial position of each of the eccentric pin shaft micro-adjustment mechanisms after machining and installing the crank, the connecting rods, and the sliding block of the multipoint crank press through a machining and installation process by a process comprising:

adjusting each of straight lines of eccentric radii of eccentric pin shafts to a horizontal plane relative to ground, wherein every two of the straight lines of the eccentric radii of different positions point to opposite directions to eliminate a lateral force generated by different eccentric pin shafts on the sliding block, rotating a position of a dial to make a reading of an adjusting pointer be zero and make the adjusting pointer point right above perpendicular to the horizontal plane, fixing the dial to the large bevel gear, fixing the large bevel gear to the connecting rods by second bolts, and fixing the adjusting pointer to a movable small bevel gear;

turning the crank, thereby moving the connecting rod, and thereby moving the sliding block to a bottom dead center, eliminating a gap among the crank, the sliding block, the connecting rods and the eccentric pin shaft micro-adjustment mechanisms by using loading by a hydraulic loader of the multipoint crank press, measuring a nonparallelism between a lower surface of the sliding block and an upper surface of a working table, adjusting the eccentric pin shaft through unloading, repeating the foregoing process of measuring a nonparallelism between the lower surface of the sliding block and the upper surface of the working table, adjusting the eccentric pin shaft through unloading until a precision threshold for assembly and operation of the multipoint crank press is met, and fixing the eccentric pin shaft to the connecting rods.

11. A method for adjustment of a multipoint crank press by using the device for adjusting a sliding block according to claim 4, comprising:

determining an initial position of each of the eccentric pin shaft micro-adjustment mechanisms after machining and installing the crank, the connecting rods, and the sliding block of the multipoint crank press through a machining and installation process by a process comprising:

adjusting each of straight lines of eccentric radii of eccentric pin shafts to a horizontal plane relative to ground, wherein every two of the straight lines of the eccentric radii of different positions point to opposite directions to eliminate a lateral force generated by different eccentric pin shafts on the sliding block, rotating a position of a dial to make a reading of an adjusting pointer be zero and make the adjusting pointer point right above perpendicular to the horizontal plane, fixing the dial to the large bevel gear, fixing the large bevel gear to the connecting rods by second bolts, and fixing the adjusting pointer to a movable small bevel gear;

turning the crank, thereby moving the connecting rods, and thereby moving the sliding block to a bottom dead center, eliminating a gap among the crank, the sliding block, the connecting rods and the eccentric pin shaft micro-adjustment mechanisms by using loading by a hydraulic loader of the multipoint crank press, measuring a nonparallelism between a lower surface of the sliding block and an upper surface of a working table, adjusting the eccentric pin shaft through unloading, repeating the foregoing process of measuring a nonparallelism between the lower surface of the sliding block and the upper surface of the working table, adjusting the eccentric pin shaft through unloading until a precision threshold for assembly and operation of the multipoint crank press is met, and finally fixing the eccentric pin shaft to the connecting rods.

12. A method for adjustment of a multipoint crank press by using the device for adjusting a sliding block according to claim 5, comprising:

determining an initial position of each of the eccentric pin shaft micro-adjustment mechanisms after machining and installing the crank, the connecting rods, and the sliding block of the multipoint crank press through a machining and installation process by a process comprising:

adjusting each of straight lines of eccentric radii of eccentric pin shafts to a horizontal plane relative to ground, wherein every two of the straight lines of the eccentric radii of different positions point to opposite directions to eliminate a lateral force generated by different eccentric pin shafts on the sliding block, rotating a position of a dial to make a reading of an adjusting pointer be zero and make the adjusting pointer point right above perpendicular to the horizontal plane, fixing the dial to the large bevel gear, fixing the large bevel gear to the connecting rods by second bolts, and fixing the adjusting pointer to a movable small bevel gear;

turning the crank, thereby moving the connecting rods, and thereby moving the sliding block to a bottom dead center, eliminating a gap among the crank, the sliding block, the connecting rods and the eccentric pin shaft micro-adjustment mechanisms by using loading by a hydraulic loader of the multipoint crank press, measuring a nonparallelism between a lower surface of the sliding block and an upper surface of a working table, adjusting the eccentric pin shaft through unloading, repeating the foregoing process of measuring a nonparallelism between the lower surface of the sliding block and the upper surface of the working table, adjusting the eccentric pin shaft through unloading until a precision threshold for assembly and operation of the multipoint crank press is met, and fixing the eccentric pin shaft to the connecting rods.

13. A method for adjustment of a multipoint crank press by using the device for adjusting a sliding block according to claim 6, comprising:

determining an initial position of each of the eccentric pin shaft micro-adjustment mechanisms after machining and installing the crank, the connecting rods, and the sliding block of a multipoint crank press through a machining and installation process by a process comprising:

adjusting each of straight lines of eccentric radii of eccentric pin shafts to a horizontal plane relative to ground, wherein every two of the straight lines of the eccentric radii of different positions point to opposite directions to eliminate a lateral force generated by different eccentric pin shafts on the sliding block, rotating a position of a dial to make a reading of an adjusting pointer be zero and make the adjusting pointer point right above perpendicular to the horizontal plane, fixing the dial to the large bevel gear, fixing the large bevel gear to the connecting rods by second bolts, and fixing the adjusting pointer to a movable small bevel gear shaft, to ensure that the multipoint crank press has a normal initial position;

turning the crank, thereby moving the connecting rods, and thereby moving the sliding block to a bottom dead center, eliminating a gap among the crank, the sliding block, the connecting rods and the eccentric pin shaft micro-adjustment mechanisms by using loading by a hydraulic loader of the multipoint crank press, measuring a nonparallelism between a lower surface of the sliding block and an upper surface of a working table, adjusting the eccentric pin shaft through unloading, repeating the foregoing process of measuring a nonparallelism between the lower surface of the sliding block and the upper surface of the working table, adjusting the eccentric pin shaft through unloading until a precision threshold for assembly and operation of the multipoint crank press is met, and fixing the eccentric pin shaft to the connecting rods.

14. A method for adjustment of a multipoint crank press by using the device for adjusting a sliding block according to claim 7, comprising:

determining an initial position of each of the eccentric pin shaft micro-adjustment mechanisms after machining and installing the crank, the connecting rods, and the sliding block of a multipoint crank press through a machining and installation process by a process comprising:

adjusting each of straight lines of eccentric radii of eccentric pin shafts to a horizontal plane relative to ground, wherein every two of the straight lines of the eccentric radii of different positions point to opposite directions to eliminate a lateral force generated by different eccentric pin shafts on the sliding block, rotating a position of a dial to make a reading of an adjusting pointer be zero and make the adjusting pointer point right above perpendicular to the horizontal plane, fixing the dial to the large bevel gear, fixing the large bevel gear to the connecting rods by second bolts, and fixing the adjusting pointer to a movable small bevel gear;

turning the crank, thereby moving the connecting rods, and thereby moving the sliding block to a bottom dead center, eliminating a gap among the crank, the sliding block, the connecting rods and the eccentric pin shaft micro-adjustment mechanisms by using loading by a hydraulic loader of the multipoint crank press, measuring a nonparallelism between a lower surface of the sliding block and an upper surface of a working table, adjusting the eccentric pin shaft through unloading, repeating the foregoing process of measuring a nonparallelism between the lower surface of the sliding block and the upper surface of the working table, adjusting the eccentric pin shaft through unloading until a precision threshold for assembly and operation of the multipoint crank press is met, and fixing the eccentric pin shaft to the connecting rods.

15. The method for adjustment according to claim 8, wherein a method for loading by the hydraulic loader comprises:

loading at a geometric center position of the lower surface of the sliding block by the hydraulic loader, wherein a loading force is 15%-50% of nominal pressure of the multipoint crank press.

16. The method for adjustment according to claim 9, wherein a method for loading by the hydraulic loader comprises:

loading at a geometric center position of the lower surface of the sliding block by the hydraulic loader, wherein a loading force is 15%-50% of nominal pressure of the multipoint crank press.

17. The method for adjustment according to claim 10, wherein a method for loading by the hydraulic loader comprises:

loading at a geometric center position of the lower surface of the sliding block by the hydraulic loader, wherein a loading force is 15%-50% of nominal pressure of the multipoint crank press.

18. The method for adjustment according to claim 11, wherein a method for loading by the hydraulic loader comprises:

loading at a geometric center position of the lower surface of the sliding block by the hydraulic loader, wherein a loading force is 15%-50% of nominal pressure of the multipoint crank press.

19. The method for adjustment according to claim 12, wherein a method for loading by the hydraulic loader comprises:

loading at a geometric center position of the lower surface of the sliding block by the hydraulic loader, wherein a loading force is 15%-50% of nominal pressure of the multipoint crank press.

20. The method for adjustment according to claim 8, wherein with a first center of a connection position of a first set of crank, connecting rod and sliding block as a reference, a difference between a reading of a second center of a connection position of another second set of crank, connecting rod and sliding block and a measured value of a reference position is measured using a dial gauge, and then unloading is performed; other positions of other sets of eccentric positions and directions of the eccentric pin shafts on cranks, connecting rods and sliding blocks mechanisms at other positions are adjusted; the movable small bevel gear is rotated according to a measured relative height reading difference and a scale on the dial gauge, so that a pointer of the dial gauge reaches a position of a measured relative height difference and stops; then loading is performed again at a geometric center position of the lower surface of the sliding block by using the hydraulic loader; the foregoing process is repeated, and adjustment directions of the eccentric pin shaft at different positions are opposite, gaps among the crank, the sliding block, the connecting rods and eccentric pin shaft micro-adjustment mechanisms are eliminated, and the eccentric pin shaft is fixed on one side of the second end of the connecting rods with a U-shaped notch until the nonparallelism between the lower surface of the sliding block and the upper surface of the working table meets design requirements.

* * * * *